US006440042B2

(12) United States Patent
Eschenbach

(10) Patent No.: US 6,440,042 B2
(45) Date of Patent: Aug. 27, 2002

(54) PATHFINDER ELLIPTICAL EXERCISE MACHINE

(76) Inventor: Paul William Eschenbach, 143 Lakeland Ave., Moore, SC (US) 29369

( * ) Notice: Subject to any disclaimer, the term of this patent is extended or adjusted under 35 U.S.C. 154(b) by 0 days.

(21) Appl. No.: 09/733,712

(22) Filed: Dec. 11, 2000

Related U.S. Application Data

(63) Continuation-in-part of application No. 09/416,122, filed on Oct. 12, 1999, now Pat. No. 6,168,552, which is a continuation-in-part of application No. 09/246,889, filed on Feb. 8, 1999, now Pat. No. 6,024,676, which is a continuation-in-part of application No. 08/871,371, filed on Jun. 9, 1997, now Pat. No. 5,957,814.

(51) Int. Cl.[7] ..... A63B 69/16; A63B 22/04
(52) U.S. Cl. ..... 482/52; 482/51; 482/57
(58) Field of Search ..... 482/51, 52, 53, 482/57, 70, 79, 80

(56) References Cited

U.S. PATENT DOCUMENTS

| | | | | | |
|---|---|---|---|---|---|
| 5,242,343 | A | | 9/1993 | Miller | 482/57 |
| 5,423,729 | A | | 6/1995 | Eschenbach | 482/70 |
| 5,529,555 | A | * | 6/1996 | Rodgers | 482/57 |
| 5,685,804 | A | | 11/1997 | Whan-Tong et al. | 482/51 |
| 5,692,994 | A | | 12/1997 | Eschenbach | 482/57 |
| 5,788,610 | A | | 8/1998 | Eschenbach | 482/52 |
| 5,836,854 | A | | 11/1998 | Kuo | 482/52 |
| 5,893,820 | A | | 4/1999 | Maresh et al. | 482/51 |
| 5,957,814 | A | | 9/1999 | Eschenbach | 482/51 |
| 5,997,445 | A | | 12/1999 | Maresh et al. | 482/70 |
| 6,042,512 | A | | 3/2000 | Eschenbach | 482/52 |
| 6,077,198 | A | * | 6/2000 | Eschenbach | 482/57 |
| 6,146,313 | A | | 11/2000 | Whan-Tong et al. | 482/51 |

* cited by examiner

*Primary Examiner*—Stephen R. Crow

(57) ABSTRACT

The present invention relates to a standup exercise apparatus that simulates walking, jogging and climbing with arm exercise. More particularly, the present invention relates to an exercise machine having separately supported pedals for the feet and arm exercise coordinated with the motion of the feet.

Elliptical trainers guide the feet along a generally elliptical shaped curve to simulate the motions of jogging and climbing. Existing elliptical trainers consume excessive floor-space and often lack adjustable pedal motion. The present invention is an improved elliptical exercise machine capable of extended exercise with adjustable pedal motion during operation. Further, the pedal stride length and pedal lift height are independently adjustable.

The intermediate portion of a foot support member is guided by a guide member and drives a crank linkage on one end with pedal on the other end. The resulting pedal motion is foot friendly. Handles are connected to the crank linkage for coordinated arm exercise.

36 Claims, 6 Drawing Sheets

PATHFINDER ELLIPTICAL EXERCISE MACHINE

This application is a Continuation-in-Part of application Ser. No. 09/416,122 filed Oct. 12, 1999 now U.S. Pat. No. 6,168,552 which is a Continuation-in-Part of Ser. No. 09/246,889 filed Feb. 8, 1999 now U.S. Pat. No. 6,024,676 which is a Continuation-in-Part of Ser. No. 08/871,371 filed Jun. 9, 1997 now U.S. Pat. No. 5,957,814.

BACKGROUND OF THE INVENTION

1. Field

The present invention relates to a standup exercise apparatus that simulates walking, jogging and climbing with arm exercise. More particularly, the present invention relates to an exercise machine having separately supported pedals for the feet and arm exercise coordinated with the motion of the feet. Pedal stride and lift are adjustable.

2. State of the Art

The benefits of regular exercise to improve overall health, appearance and longevity are well documented in the literature. For exercise enthusiasts the search continues for safe apparatus that provides full body exercise for maximum benefit in minimum time.

Recently, a new category of exercise equipment has appeared on the commercial market called elliptical cross trainers. These cross trainers guide the feet along a generally elliptical shaped curve to simulate the motions of jogging and climbing. Generally they are large exercise machines using long cranks to generate a long foot stride. There is a need for a more compact elliptical exercise machine capable of a similar long stride using a linkage to modify the crank.

Recently, there has been an effort to improve the up and down motion of stair climbers by the addition of horizontal movements. Habing in U.S. Pat. Nos. 5,299,993 and 5,499,956 offers an articulated linkage controlled through cables by motor to move pedals through an ovate path. Both pedal pivots follow basically the same guidance path curve directed by a motor controller. Stearns in U.S. Pat. Nos. 5,290,211 and 5,299,993 shows a stair stepping exercise machine which incorporates horizontal movement using a combination of vertical parallelogram linkage and horizontal parallelogram linkage to guide the foot pedals. The parallelogram linkages serve to maintain the pedal at a constant angle relative to the floor during a pedal cycle. The pedal pivots move through similar undefined guide paths.

Standup cycling is described in various patents such as U.S. Pat. No. 3,563,541 (Sanquist) which uses weighted free pedals as load resistance and side to side twisting motion. Also U.S. Pat. Nos. 4,519,603 and 4,477,072 by DeCloux describe standup cycling with free pedals in a lift mode to simulate body lifting. Eschenbach in U.S. Pat. No. 5,279,529 shows several embodiments of elliptical pedal motion configured to maintain the heel of the user on the pedal during a substantial portion of the pedal cycle.

Standup pedal exercise is shown in U.S. Pat. No. 4,643,419 (Hyde) and by Jarriel et al. In U.S. Pat. No. D330,236 where pedal platforms move by dual crank motion but remain parallel to the floor. Knudsen in U.S. Pat. No. 5,433,680 shows an elliptical path generating mechanism with pedals having only one pivot allowing the pedal to rotate unconstrained about the pivot as in a bicycle crank.

Standup pedal exercise combined with arm levers attached to the pedals is shown in Kummerlin et al. German Pat. No. 2,919,494 and in Geschwender U.S. Pat. No. 4,786,050. Standup pedal exercise coupled with oscillating swing arms is shown in Miller U.S. Pat. Nos. 5,242,343 and 5,383,829 and in Eschenbach U.S. Pat. No. 5,423,729. All of these exercise machines use pedals having two pedal pivots which are guided by a first circular guide path curve generated by a crank which rotates through one full revolution during a pedal cycle and a second arc guide path curve generated by a rocker link or track.

Recently, numerous elliptical exercise machines have appeared in the patent literature. Rogers,Jr. in U.S. Pat. Nos. 5,527,246, 5,529,555, 5,540,637, 5,549,526, 5,573,480, 5,591,107, 5,593,371, 5,593,372, 5,595,553, 5,611,757, 5,637,058, 5,653,662 and 5,743,834 shows elliptical pedal motion by virtue of various reciprocating members and geared linkage systems. Miller in U.S. Pat. Nos. 5,518,473, 5,562,574, 5,611,756, 5,518,473, 5,562,574, 5,577,985, 5,755,642 and 5,788,609 also shows elliptical pedal motion using reciprocating members and various linkage mechanisms along with oscillating guide links with control links to determine pedal angles. Ryan et al. in U.S. Pat. No. 5,899,833 shows an elliptical cross trainer having a forward crank driving a pedal linkage underneath the operator.

Chang in U.S. Pat. No. 5,803,872 and Yu et al. in U.S. Pat. No. 5,800,315 show a pedal supported by a rocker link and driven with a pair of links located under the pedal pivotally connected to a crank. Maresh et al. in U.S., Pat. No. 5,792,026 show a foot support member supported by a rocker link and driven by a double crank mechanism. Maresh in U.S. Pat. No. 5,897,463 shows a foot platform with parallel movement as the the foot platform follows an oval path. Lee in U.S. Pat. No. 5,779,598 and Chen in U.S. Pat. No. 5,823,914 show a pedal link driven by two separate cranks. Lin et al. in U.S. Pat. No. 5,769,760 offers elliptical foot and hand motion. Sands et al. U.S. Pat. No. 5,755,643 shows elliptical foot motion with folding front post.

Lee in U.S. Pat. No. 5,746,683 shows a foot support member supported on one end with a compound rocker wherein a slider and handle lever support the rocker. Kuo in U.S. Pat. No. 5,836,854 offers a linear foot support member connected on one end to a crank and guided along an arcuate curve under the pedal by a linkage on the other end. Wang et al. U.S. Pat. No. 5,830,112 shows a foot support member sliding on a pivot on one end and attached to a crank on the other that can fold. Chen U.S. Pat. No. 5,823,917 shows a foot support member driven by a crank on one end and supported by a stationary roller on the other. Chen U.S. Pat. No. 5,820,524 offers a slider crank mechanism having a pedal pivotally attached with a control link to articulate the pedal angle.

Chen U.S. Pat. Nos. 5,779,599 and 5,762,588 shows an elliptical pedal movement with a roller interface between the foot support member and crank. Chen in U.S. Pat. No. 5,759,136 shows a foot support member with a moving pedal for adjustable elliptical motion wherein a link from the pedal to the crank can be repositioned to change the pedal stroke length. Kuo U.S. Pat. No. 5,846,166 shows a foot support member guided on one end by a roller and driven on the other end by a four bar linkage. Stearns et al. in U.S. Pat. No. 5,848,954 offers a foot support member pivoted on one end with a lift crank on the other and a pedal moving on the foot support member to generate elliptical type foot motion.

Maresh et al. in U.S. Pat. Nos. 5,893,820 and 5,997,445 shows an adjustable lift elliptical cross trainers. Kuo U.S. Pat. No. 5,836,854 shows a foot support member driven by a crank and guided on one end by a linkage hanging from a "Z" shaped bar that may be adjusted. Whan-Tong et al. in U.S. Pat. Nos. 5,685,804 and 6,146,313 shows a foot support member driven by a simple crank having an adjustable ramp to vary pedal lift. Eschenbach in U.S. Pat. No. 5,692,994 shows an elliptical cross trainer which has an adjustable upright support member which allows variable pedal motion.

There is a need for a pedal operated exercise machine that can be safely operated in the standup position whereby the arms and legs can be exercised with the feet moving through a generally elliptical movement that can be fully adjusted.

It is one objective of this invention to provide an elliptical pedal movement with a crank linkage that provides both a pedal stride and pedal lift adjustment that may be independently varied. Another object of this invention is to provide an oblong pedal path that can be adjusted during operation of the exercise machine by a control system. Yet another object of this invention is to provide arm exercise that is coordinated with the pedal movement.

SUMMARY OF THE INVENTION

The present invention relates to the kinematic motion control of pedals which simulate running, climbing and cycling during several modes of operation. More particularly, apparatus is provided that offers variable intensity exercise through a leg operated cyclic motion in which the pedal supporting each foot is guided through successive positions during the motion cycle while a load resistance acts upon the mechanism.

The pedals are guided through an oblong or elongate curve motion while pedal angles vary during the pedal cycle to maintain the heel of the foot generally in contact with the pedal. As the foot is raised, the heel of the foot remains generally in contact with the inclining pedal for safer operation. Arm exercise is by arm levers coordinated with the mechanism guiding the foot pedals.

In the preferred embodiment, the apparatus includes a separate pedal for each foot, each pedal being extended by a foot support member and partially supported by an oblong guide path curve for the first foot support member portion at a foot support pivot. The oblong guide path generating mechanism has a rotary crank which completes one full revolution during a pedal cycle and is phased generally opposite the crank for the other pedal through a crankshaft bearing housing attached to the framework.

A rocker link is pivotally connected to the framework. A coupler link is connected to the crank at a crank pivot and the rocker link is connected to the coupler link at a rocker pivot to form a path generating mechanism. The coupler link is connected to the foot support member at a foot support pivot in the portion that follows an elongate guide path curve. The rocker pivot is offset relative to a line connecting the crank pivot and foot support pivot on the coupler link.

The foot support member is supported at a second foot support member portion with a pivot by foot support guides configured as rollers supported by curved tracks supported by the framework. As the crank is driven by foot motion, the pedal follows an elongate curve approximating an ellipse.

Arm exercise is provided with handles pivotally connected to the framework. A connector link is pivotally connected to each handle and each coupler link between the foot support member and the crank pivot to coordinate the arm movement with the foot. The connector link pivot can also coincide with the crank pivot. When the foot is forward, the handle corresponding to that foot is generally rearward.

An actuator is connected to each coupler link to move a rocker pivot collar containing the rocker pivot closer or further away from the crank pivot to change the pedal stride. A control system positioned near the operator can adjust the actuators during operation to reposition the rocker pivot collars for a change in pedal stride length.

The curved tracks are are movable back and forth relative to the framework by an actuator pivotally connected to the framework. A control system positioned near the operator can adjust the actuator during operation to reposition the curved tracks for a change in pedal lift height.

Load resistance is imposed upon the crank through pulleys and belt engaged with a flywheel. A jackshaft is intermediate the crank and flywheel to increase flywheel speed. An alternator is connected to the flywheel. A control system within easy reach of the operator can adjust the alternator load resistance during operation of the exercise machine.. Other forms of load resistance such as friction belt, magnetic, air, belt, etc. may also be used.

In an alternate embodiment, the curved tracks are pivotally connected to the framework at the rear ends of the tracks. An actuator controlled lever arm supports the forward end of the tracks. The tracks can also be pivoted at the forward end or intermediate the track ends and be within the scope of the present invention. The remainder of the exercise machine is similar to the preferred embodiment.

In summary, this invention provides the operator with stable foot pedal support having motions that simulate running, jogging and climbing with very low joint impact and upper body exercise. The pedal motion is adjustable during operation to independently change the pedal stride length and pedal lift height. Arm exercise is coordinated with the pedal motion but changes very little with pedal motion adjustment.

DETAILED DESCRIPTION OF THE EMBODIMENTS

Figure 1:
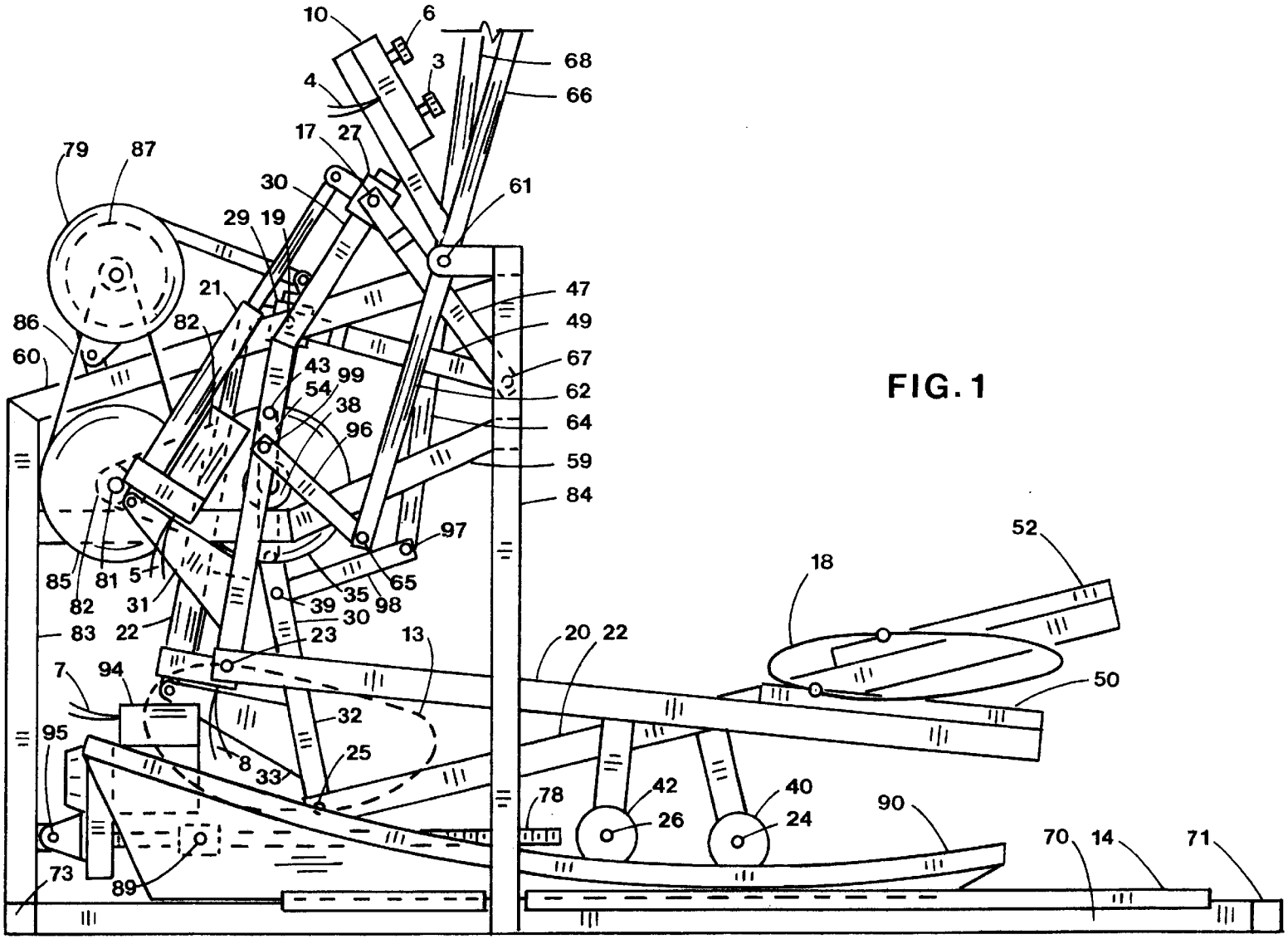
FIG. 1 is a right side elevation view of the preferred embodiment of an exercise machine constructed in accordance with the present invention adjusted for shorter pedal stride and lower pedal lift.
Figure 2:
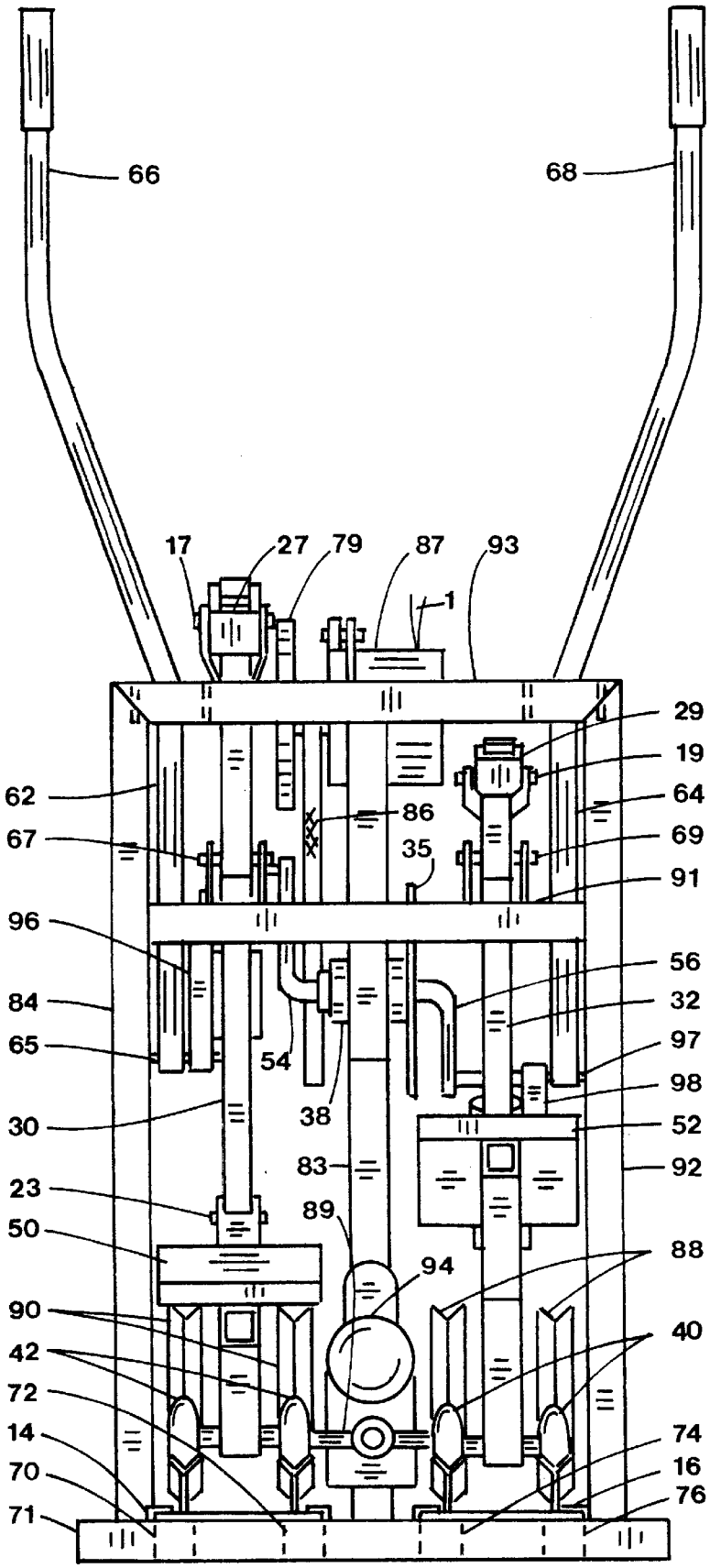
FIG. 2 is the rear view of the preferred embodiment shown in FIG. 1.

Referring to the drawings in detail, pedals 52 and 50 are shown in FIGS. 1 and 2 in generally their highest and lowermost positions of the first embodiment. Pedals 50 and 52 are supported by foot support members 20 and 22 which have first foot support pivots 23,25 in a first portion and second foot support pivots 26,24 in a second portion, respectively. Foot support pivots 23 and 25 are pivotally attached to coupler links 30 and 32 which guide pedal pivots 23 and 25 along an elongate guide path curve 13.

Coupler link 30 is connected to rocker link 47 at rocker pivot 17 and to crank 54 at crank pivot 43 while coupler link 32 is connected to rocker link 49 at rocker pivot 19 and to crank 56 at crank pivot 46. Rocker pivots 17,19 are offset relative to lines which connect crank pivots 43,46 to foot support pivots 23,25 on coupler links 30,32. Further, rocker pivots 17,19 are attached to rocker pivot collars 27,29 which can be moved on coupler links 30,32 closer or further away from crank pivots 43,46.

Cranks 54 and 56 are connected in opposing directions by crankshaft journal 55 (not shown) which is rotatably secured to the framework by bearing housing 38. Rocker links 47 and 49 are pivotally attached to crossover support member 91 at pivots 67 and 69, respectively. Cranks 54,56, rocker links 47,49 and coupler links 30,32 form a path generating mechanism.

Actuators 21,22 are attached to coupler link extensions 31,33 and to rocker pivot collars 27,29. Adjustment of the actuators 21,22 cause the rocker pivot collars 27,29 to be repositioned relative to the crank pivots 43,46 to change the length of pedal curve 18. Locking solenoids (not shown) activated from the control system 10 can be added to secure the rocker pivot collars 27,29 to coupler links 30,32 during operation.

FIGS. 1 and 2 show actuators 21,22 extended which results in the shorter stride length curve 18. Control system 10 has wires 4 connected to actuator wires 5,8 by conventional means not shown. Control system 10 can be activated by control knob 6 or automatic program during operation of the exercise machine to vary the pedal stride length.

Handles 66,68 are attached to crossover support member 93 at pivots 61,63 for arm exercise. Connector links 96,98 are connected to handle extensions 62,64 by pivots 65,97 and to coupler links 30,32 at pivots 99,39.

Curved tracks 88,90 are constrained by track guides 14,16 to move back and forth on frame members 70,72,74,76. Rollers 42,40 are attached to foot support members 20,22 in a second portion at pivots 26,24 and in rollable contact with curved tracks 90,88 for back and forth movement. Actuator 94 is connected to frame member 83 at pivot 95. Actuator screw 78 will move actuator pivot 89 which is attached to curved tracks 88,90. FIGS. 1 and 2 show curved tracks 88,90 in their most forward position to allow pedals 50,52 to follow stride pedal curve 18.

Control system 10 has wires 4 connected to actuator wires 7 by conventional means not shown. Control knob 3 or automatic program will move curved tracks 88,90 to a more rearward position to change the pedal 50,52 lift height.

Frame members 70,72,74,76 are attached to crossover members 71,73 configured to be supported by the floor. Frame members 83,84,92 are attached to frame members 70,76,73. Crossover support members 91,93 connect frame members 84,92. Frame member 59 connects crossover support member 91 to frame member 83 and supports crank housing 38. Frame member 60 connects crossover support member 93 to frame member 83.

Flywheel 79 is rotatably supported by alternator 87. Belt 86 is engaged with flywheel 79 and jackshaft pulley 85. Pulley 85 and pulley 82 are attached to jackshaft 81. Chain or belt 82 is engaged with pulleys 82 and 35 to impose load resistance on cranks 54,56.

Control system 10 is attached to support member 60. Wires 4 are connected to alternator wires 1 by conventional means not shown. A switch such as 3,6 can be manually changed during operation by the operator to vary load intensity or by automatic program.

Application of body weight on the pedals 50,52 and force applied at the arm levers 66,68 cause the flywheel 79 to rotate for a gain in momentum while the pedals 50,52 follow the pedal curve 18 shown adjusted to a stride pedal 50,52 motion. The flywheel 79 momentum will carry the linkage system through any dead center positions of the crank 54,56. The pedals 50,52 and arm levers 66,68 can be operated to drive the flywheel 79 in either direction of rotation.

Figure 3:
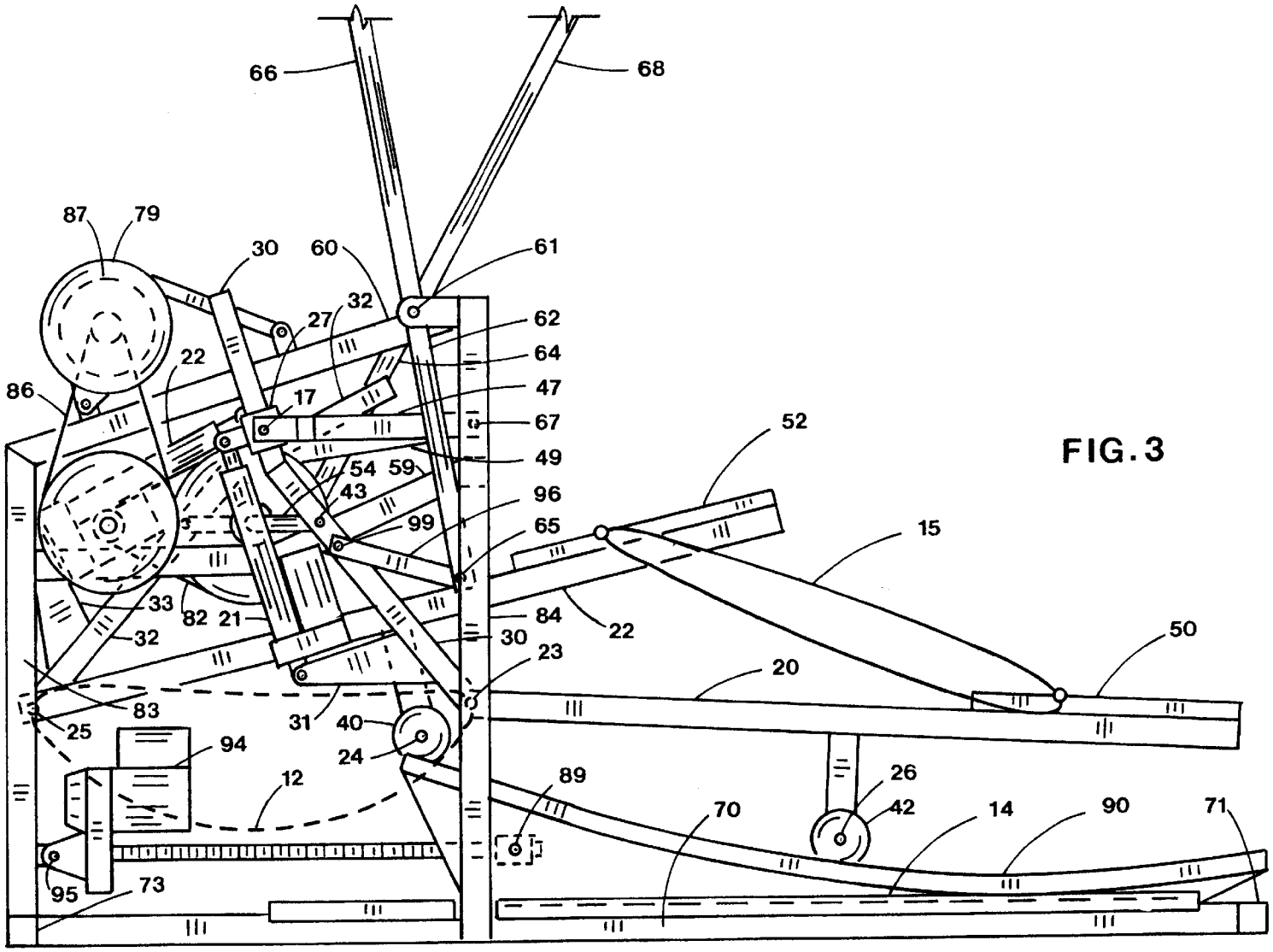
FIG. 3 is a side elevation view of the preferred embodiment of the present invention adjusted for longer pedal stride and higher pedal lift.
Figure 4:
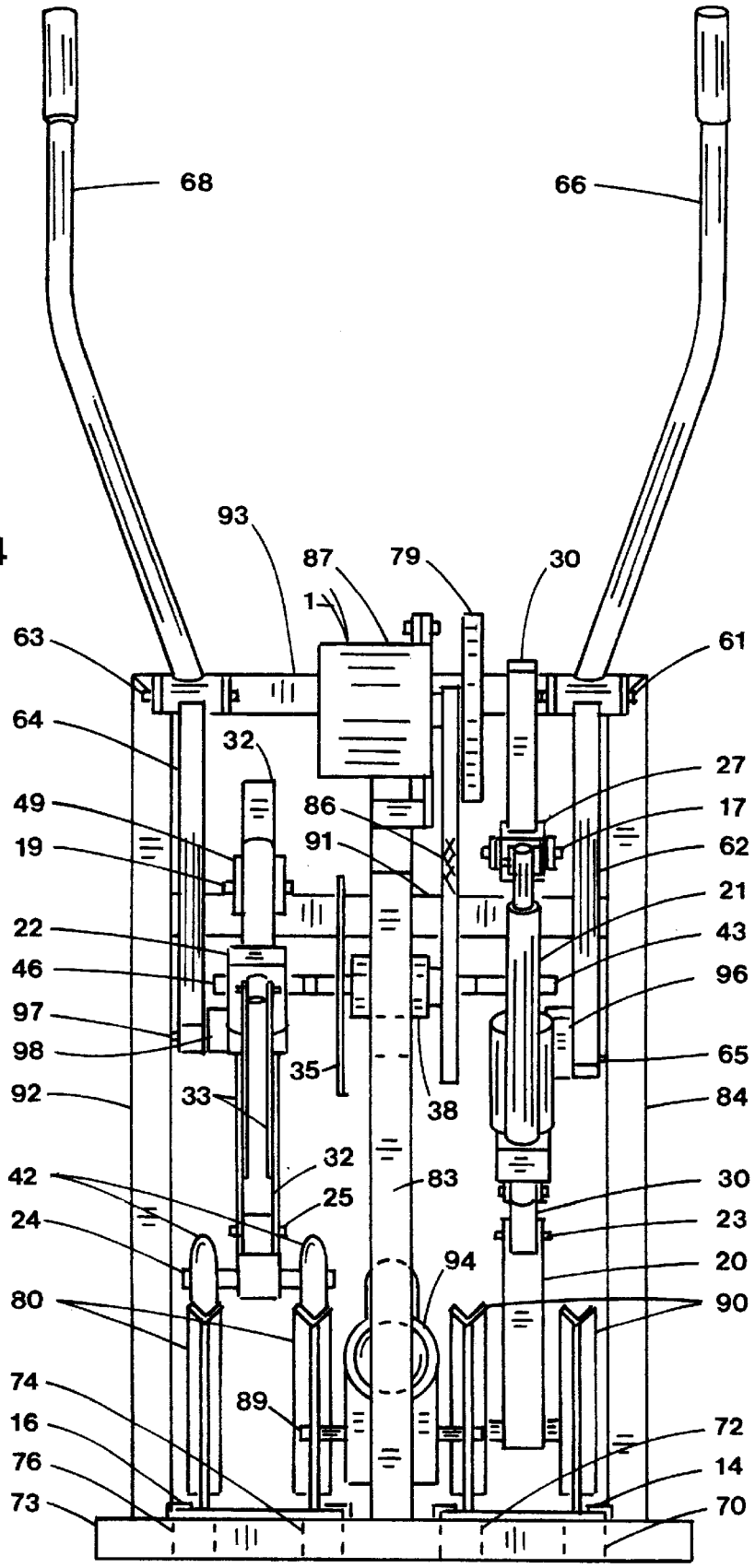
FIG. 4 is a front view of the preferred embodiment shown in FIG. 3.
Figure 5:
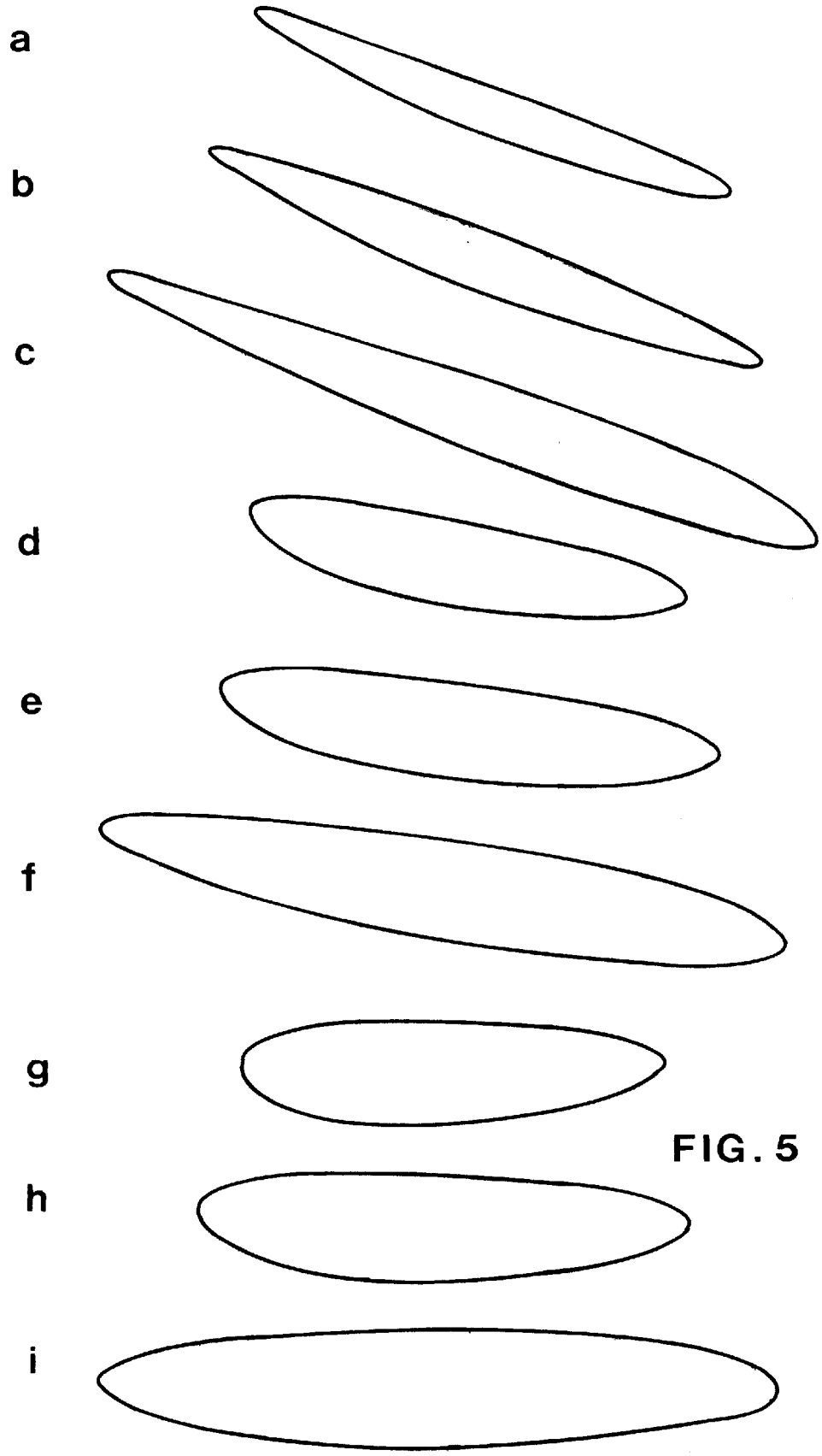
FIG. 5 is a collection of the different pedal curve paths obtainable with the preferred embodiment of FIG. 1.

In FIGS. 3 and 4, the preferred embodiment is shown with pedals 52,50 in the most forward and rearward positions. Actuators 21,22 are shown compressed causing the long pivot curve 31 and resulting in a longer pedal stride curve 15. Actuator 94 has moved curved tracks 88,90 to a rearward position causing the rollers 40,42 to traverse the forward inclined portion of tracks 88,90. The more inclined travel of rollers 40,42 result in the higher lift pedal curve 15. FIG. 5 shows some of the variety of Pathfinder curves a,b,c,d,e,f, g,h and i available as actuators 21,22 for stride adjustment and actuator 94 for pedal lift height adjustment are independently varied to achieve the desired pedal motion for running, jogging, climbing or some combination thereof.

Figure 6:
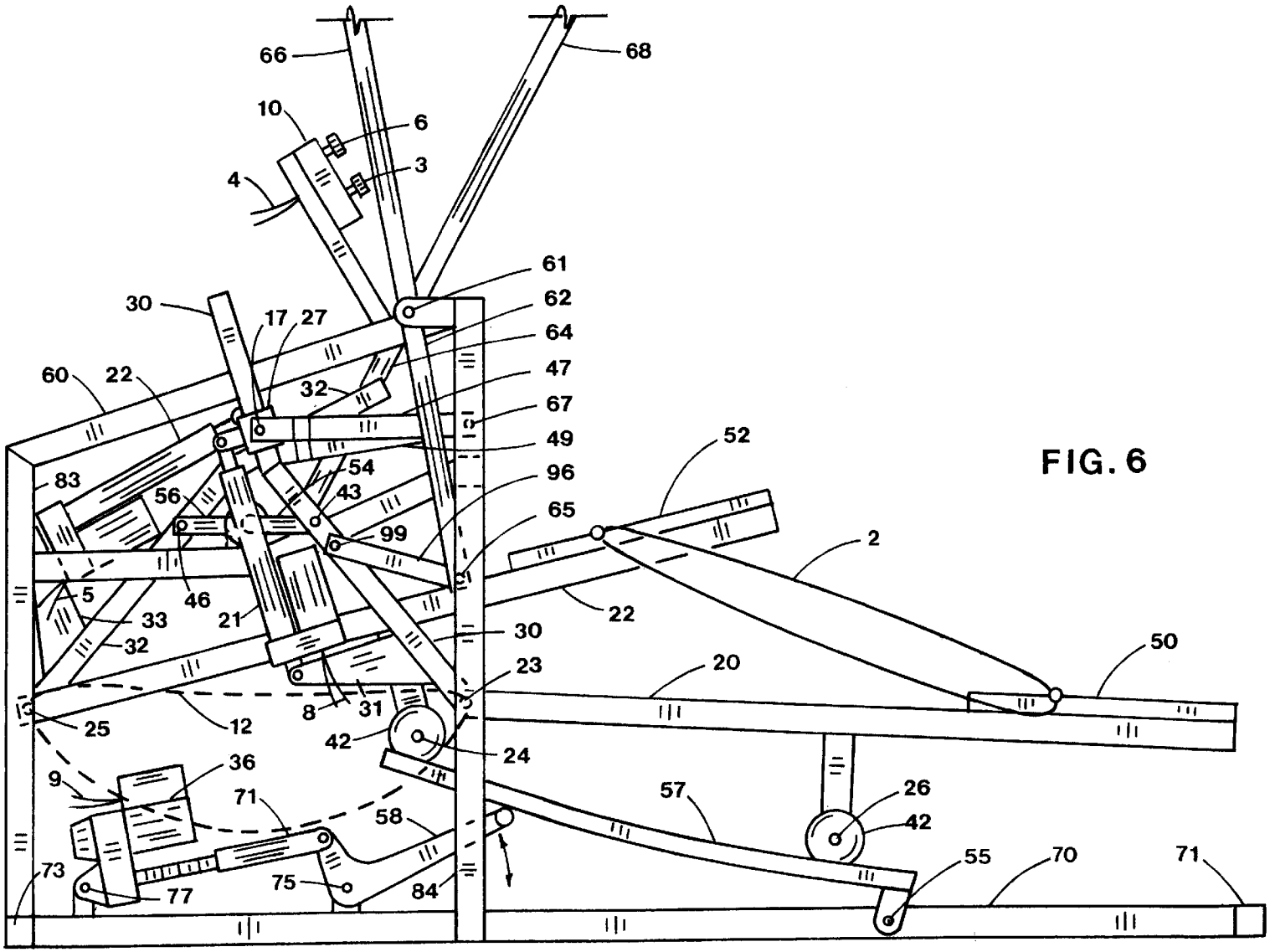
FIG. 6 is a side elevation view of an alternate embodiment adjusted for longer pedal stride and higher pedal lift.

In an alternate embodiment, pedals 52,50 are shown in the most forward and rearward positions in FIG. 6. Long curved tracks 88,90 have been replaced with shorter tracks 57 which can be curved or linear. Tracks 57 are connected to frame members 70,72,74,76 by pivots 55. Actuator 36 is connected to frame members 72,74 at pivot 77. Actuator extension 71 is connected to lever arm 58 which is connected to frame members 72,74 at pivot 75. The other end of lever arm 58 supports the forward end of tracks 57. Lowering tracks 57 cause lower pedal lift height. Control system 10 causes actuator 36 to raise or lower the forward ends of tracks 57 during operation by knob 3 or automatic means. Actuator wires 9 are connected to control wires 4 by conventional means not shown. The remainder of the alternate embodiment is similar to the preferred embodiment including independently adjustable actuators 21,22 to vary pedal stride length. Pedal curve 2 shows a long pedal stride and higher pedal lift. Load resistance is not shown for clarity.

The present invention may be embodied in other specific forms without departing from its spirit or essential characteristics. The described embodiments are to be considered in all respects only as illustrative, and not restrictive. The scope of the invention is, therefore, indicated by the claims, rather than by foregoing description. All changes which come within the meaning and range of equivalency of the claims are to be embraced within their scope.

What is claimed is:

1. An exercise machine comprising:

a framework, said framework configured to be supported by the floor;

a pair of foot support members, each having a first portion, a second portion and a foot engaging pedal;

a crank, said crank rotatably attached to said framework projecting outwardly therefrom on both sides thereof;

a pair of path generating mechanisms, each said path generating mechanism including a plurality of links operably associated with said crank and said framework to support said first portion of said foot support member;

a pair of tracks, each said track operably associated with said foot support member and said framework to cause said second portion of said foot member to have a back and forth movement;

a means for stride adjustment, said means for stride adjustment operably associated with said path generating mechanisms to vary the horizontal stride length of said pedal;

said pedal configured to move relative to said framework when the foot of the user is rotating said crank whereby said pedal follows an oblong curve path.

2. The exercise machine according to claim 1 wherein said oblong curve path is generally elliptical in shape.

3. The exercise machine according to claim 1 wherein each said path generating mechanism comprises a linkage, said linkage including a rocker link pivotally connected to said framework and, a coupler link operably associated with said crank and said rocker link, said linkage configured to guide said first portion of said foot support member.

4. The exercise machine according to claim 3 wherein said means for stride adjustment is operably associated with said coupler link and said rocker link to change the position of said rocker link relative to said coupler link causing a change in pedal motion.

5. The exercise machine according to claim 1 further comprising a roller, said roller rotatably connected to said second portion of said foot support member and in rollable contact with said track.

6. The exercise machine according to claim 1 further comprising a means for arm exercise, said means for arm exercise operably associated with said path generating mechanism.

7. The exercise machine according to claim 6 wherein said means for arm exercise comprises a pair of handles, each said handle pivotally connected to said framework and a pair of connector links, each said connector link operably associated with said handle and said path generating mechanism.

8. The exercise machine according to claim 1 further comprising a flywheel, said flywheel rotatably connected to said framework and operably associated with said crank.

9. The exercise machine according to claim 1 further comprising a load resistance, said load resistance operably associated with said crank, a means for adjustment of said load resistance and, a control system, said control system positioned within reach of the operator whereby said load resistance can be varied during operation of said exercise machine.

10. The exercise machine according to claim 1 wherein said foot support member is configured with said pedal on one end and said first portion at the other end with said second portion positioned intermediate the ends.

11. The exercise machine according to claim 5 wherein said track is curved to support said roller.

12. The exercise machine according to claim 3 wherein said crank is connected to said coupler link at a crank pivot, said foot support member is connected to said coupler link at a foot support pivot and, said rocker link is connected to said coupler at a rocker pivot positioned offset relative to a line connecting said crank pivot and said foot support pivot.

13. The exercise machine according to claim 1 further comprising a means for pedal lift adjustment, said means for pedal lift adjustment operably associated with said track and, a control system, said control system positioned within reach of the operator and operably associated with said means for pedal lift adjustment whereby the position of said track can be varied during operation of said exercise machine.

14. The exercise machine according to claim 1 wherein said track is curved and movable horizontally back and forth relative to said frame to change the pedal motion of said exercise machine.

15. The exercise machine according to claim 13 wherein said means for pedal lift adjustment can change the angular orientation of said track to change the pedal motion of said exercise machine.

16. The exercise machine according to claim 13 wherein said means for stride adjustment and said means for pedal lift adjustment are independently operative to adjust either the stride or lift height of said pedal motion.

17. An exercise machine comprising:

a framework, said framework configured to be supported by the floor;

a pair of foot support members, each having a first portion, a second portion and a foot engaging pedal;

a crank, said crank rotatably attached to said framework projecting outwardly therefrom on both sides thereof;

a pair of path generating mechanisms, each said path generating mechanism including a plurality of links operably associated with said crank and said framework to support said first portion of said corresponding foot support member along an elongate curve path;

a pair of tracks, each said track operably associated with said foot support member and said framework to cause said second portion of said foot member to have a back and forth movement;

a pair of rollers, each said roller rollably attached to said second portion of said foot support member and in rollable contact with said track;

a first means for adjustment, said first means for adjustment operably associated with said track and said framework to change the pedal lift height;

a second means for adjustment, said second means for adjustment operably associated with said path generating mechanisms to change pedal stride length;

said pedal configured to move relative to said framework when the foot of the user is rotating said crank whereby either said means for adjustment can be adjusted to change the pedal motion of said exercise machine.

18. The exercise machine according to claim 17 wherein each said path generating mechanism comprises a linkage, said linkage including a rocker link pivotally connected to said framework and, a coupler link operably associated with said crank and said rocker link, said linkage configured to guide said first portion of said foot support member.

19. The exercise machine according to claim 17 further comprising a means for arm exercise, said means for arm exercise operably associated with said path generating mechanism.

20. The exercise machine according to claim 17 wherein said means for arm exercise comprises a pair of handles, each said handle pivotally connected to said framework and a pair of connector links, each said connector link operably associated with said handle and said path generating mechanism.

21. The exercise machine according to claim 17 further comprising a flywheel, said flywheel rotatably connected to said framework and operably associated with said crank.

22. The exercise machine according to claim 17 further comprising a load resistance, said load resistance operably associated with said crank, a means for adjustment of said load resistance and, a control system, said control system positioned within reach of the operator whereby said load resistance can be varied during operation of said exercise machine.

23. The exercise machine according to claim 18 wherein said second means for adjustment is operably associated with said coupler link and said rocker link to change the position of said rocker link relative to said coupler link causing a change in pedal motion.

24. The exercise machine according to claim 18 wherein said crank is connected to said coupler link at a crank pivot, said foot support member is connected to said coupler link at a foot support pivot and, said rocker link is connected to said coupler at a rocker pivot positioned offset relative to a line connecting said crank pivot and said foot support pivot.

25. The exercise machine according to claim 17 further comprising a control system, said control system positioned within reach of the operator whereby either said means for adjustment can be varied during operation of said exercise machine to change the pedal motion.

26. The exercise machine according to claim 17 wherein said track is curved to support said roller.

27. The exercise machine according to claim 17 wherein said track is curved and movable horizontally back and forth relative to said frame by said first means for adjustment to change the pedal motion of said exercise machine.

28. An exercise machine comprising:

a framework, said framework configured to be supported by the floor;

a pair of foot support members, each having a first portion, a second portion and a foot engaging pedal;

a crank, said crank rotatably attached to said framework projecting outwardly therefrom on both sides thereof;

a pair of path generating mechanisms, each said path generating mechanism including a plurality of links operably associated with said crank and said framework to support said first portion of said corresponding foot support member along an elongate curve path at least one said link having a changeable length for varying the elongate curve path at least one said link having a changeable lenght for varying the elongate curve path;

a pair of tracks, each said track operably associated with said foot support member and said framework to cause said second portion of said foot member to have a back and forth movement;

a pair of rollers, each said roller rollably attached to said second portion of said foot support member and in rollable contact with said track;

a pair of adjustment means, each said adjustment means operably associated with at least one of said links of said path generating mechanism to vary said elongate curve path;

said pedal configured to move relative to said framework when the foot of the user is rotating said crank whereby said means for adjustment can be adjusted to change the pedal motion of said exercise machine.

29. The exercise machine according to claim 28 wherein each said path generating mechanism comprises a linkage, said linkage including a rocker link pivotally connected to said framework and, a coupler link operably associated with said crank and said rocker link, said linkage configured to guide said first portion of said foot support member.

30. The exercise machine according to claim 28 further comprising a means for arm exercise, said means for arm exercise operably associated with said path generating mechanism.

31. The exercise machine according to claim 30 wherein said means for arm exercise comprises a pair of handles, each said handle pivotally connected to said framework and a pair of connector links, each said connector link operably associated with said handle and said corresponding path generating mechanism.

32. The exercise machine according to claim 28 further comprising a flywheel, said flywheel rotatably connected to said framework and operably associated with said crank.

33. The exercise machine according to claim 28 further comprising a load resistance, said load resistance operably associated with said crank, a means for adjustment of said load resistance and, a control system, said control system positioned within reach of the operator whereby said load resistance can be varied during operation of said exercise machine.

34. The exercise machine according to claim 28 further comprising a control system, said control system positioned within reach of the operator whereby said adjustment means can be varied during operation of said exercise machine to change the pedal motion.

35. The exercise machine according to claim 28 further comprising a second means for adjustment, said second means for adjustment operably associated with said track and, a control system, said control system positioned within reach of the operator and operably associated with said second means for adjustment whereby the position of said track can be varied during operation of said exercise machine.

36. The exercise machine according to claim 28 wherein said track is curved and movable horizontally back and forth relative to said frame to change the pedal motion of said exercise machine.

* * * * *